US005534014A

United States Patent [19]

Demeritt et al.

[11] Patent Number: 5,534,014

[45] Date of Patent: Jul. 9, 1996

[54] PILLOW PACIFIER

[76] Inventors: Kevin D. Demeritt; Debra E. Demeritt, both of 11114 Black Forest Way, Gaithersburg, Md. 20879

[21] Appl. No.: 299,960

[22] Filed: Sep. 2, 1994

[51] Int. Cl.[6] ..... A61J 17/00

[52] U.S. Cl. ..... 606/236; 606/234; D24/194

[58] Field of Search ..... 606/234–236; D24/194–199; 446/71, 72, 227, 268, 304

[56] References Cited

U.S. PATENT DOCUMENTS

| | | | |
|---|---|---|---|
| 3,129,709 | 4/1964 | Rountree | 606/236 |
| 4,188,747 | 2/1980 | Kramer | 606/234 |
| 4,697,589 | 10/1987 | King et al. | 606/234 |
| 4,726,551 | 2/1988 | Randall et al. | 248/102 |
| 5,133,740 | 7/1992 | Kussick | 606/234 |
| 5,263,975 | 11/1993 | LaRocca | 606/236 |
| 5,344,355 | 9/1994 | Silverstein | 606/234 |
| 5,391,184 | 2/1995 | Rosenthal | 606/236 |

*Primary Examiner*—Michael H. Thaler
*Assistant Examiner*—Glenn Dawson

[57] ABSTRACT

A pacifier for satisfying an infant's desire to bite and feed, as well as the infant's desire to grasp objects. The inventive device includes an elongated main body formed of a compressible material which the infant can grasp. A pacifier is removably coupled to a side of the main body such that the main body will extend along a center of the upper torso portion of the infant during use of the pacifier, whereby the infant can embrace and manipulate the device as desired.

14 Claims, 4 Drawing Sheets

PILLOW PACIFIER

BACKGROUND OF THE INVENTION

1. Field of the Invention

The present invention relates to pacifier structures and more particularly pertains to a pillow pacifier for satisfying an infant's desire to bite and feed, as well as the infant's desire to grasp objects.

2. Description of the Prior Art

The use of pacifier structures is known in the prior art. More specifically, pacifier structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art pacifier structures include U.S. Pat. No. 4,994,075; U.S. Pat. No. 4,277,910; U.S. Pat. No. 3,557,776; U.S. Pat. No. D,318,122; and U.S. Pat. No. D,316,793.

While these devices fulfill their respective, particular objectives and requirements, the aforementioned patents do not disclose a pillow pacifier for satisfying an infant's desire to bite and feed, as well as the infant's desire to grasp objects which includes an elongated main body formed of a compressible material which the infant can grasp, with a pacifier removably coupled to the side of the main body such that the main body will extend along a center of the upper torso portion of the infant during use of the pacifier.

In these respects, the pillow pacifier according to the present invention substantially departs from the conventional concepts and designs of the prior art, and in so doing provides an apparatus primarily developed for the purpose of simultaneously satisfying an infant's desire to bite and grasp objects.

SUMMARY OF THE INVENTION

In view of the foregoing disadvantages inherent in the known types of pacifier structures now present in the prior art, the present invention provides a new pillow pacifier construction wherein the same can be utilized for satisfying an infant's desire to bite and feed, while simultaneously satisfying the infant's desire to grasp objects. As such, the general purpose of the present invention, which will be described subsequently in greater detail, is to provide a new pillow pacifier apparatus and method which has many of the advantages of the pacifier structures mentioned heretofore and many novel features that result in a pillow pacifier which is not anticipated, rendered obvious, suggested, or even implied by any of the prior art pacifier structures, either alone or in any combination thereof.

To attain this, the present invention generally comprises a pacifier for satisfying an infant's desire to bite and feed, as well as the infant's desire to grasp objects. The inventive device includes an elongated main body formed of a compressible material which the infant can grasp and lean on. A pacifier is removably coupled to a side of the main body such that the main body will extend along a center of the upper torso portion of the infant during use of the pacifier, whereby the infant can embrace and manipulate the device as desired.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new pillow pacifier apparatus and method which has many of the advantages of the pacifier structures mentioned heretofore and many novel features that result in a pillow pacifier which is not anticipated, rendered obvious, suggested, or even implied by any of the prior art pacifier structures, either alone or in any combination thereof.

It is another object of the present invention to provide a new pillow pacifier which may be easily and efficiently manufactured and marketed.

It is a further object of the present invention to provide a new pillow pacifier which is of a durable and reliable construction.

An even further object of the present invention is to provide a new pillow pacifier which is susceptible of a low cost of manufacture with regard to both materials and labor, and which accordingly is then susceptible of low prices of sale to the consuming public, thereby making such pillow pacifiers economically available to the buying public.

Still yet another object of the present invention is to provide a new pillow pacifier which provides in the apparatuses and methods of the prior art some of the advantages thereof, while simultaneously overcoming some of the disadvantages normally associated therewith.

Still another object of the present invention is to provide a new pillow pacifier for satisfying an infant's desire to bite and feed, as well as the infant's desire to grasp objects.

Yet another object of the present invention is to provide a new pillow pacifier which includes an elongated main body formed of a compressible material which the infant can grasp and lean on, with a pacifier removably coupled to each side of the main body such that the main body will extend along a center of the upper torso portion of the infant during use of the pacifier.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
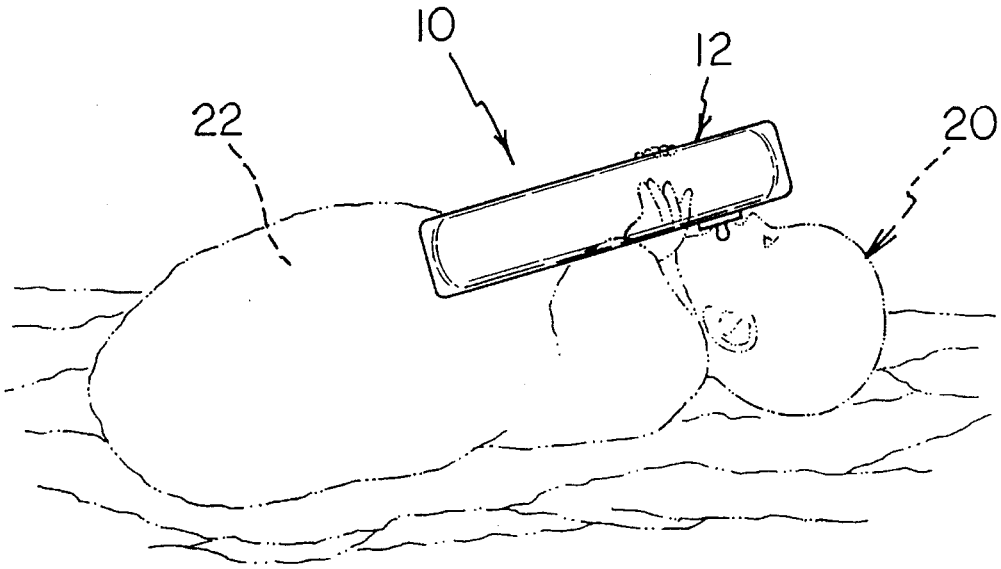
FIG. 1 is a side elevation view of a pillow pacifier according to the present invention in use.
Figure 2:
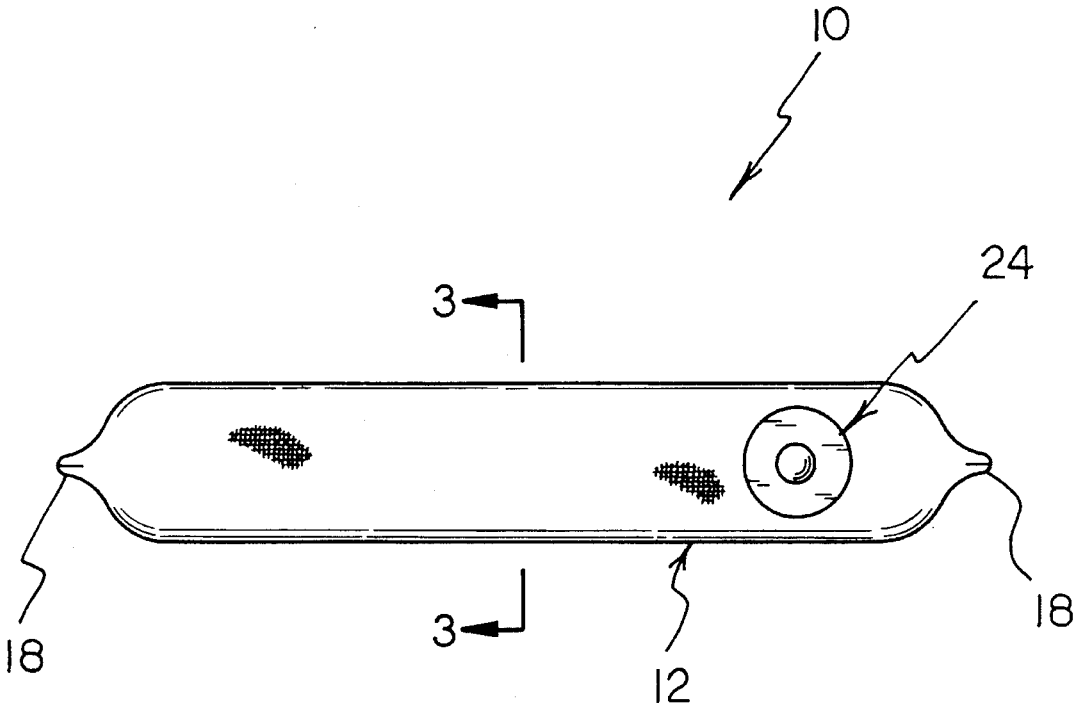
FIG. 2 is a front elevation view thereof.

With reference now to the drawings, and in particular to FIGS. 1–8 thereof, a new pillow pacifier embodying the principles and concepts of the present invention and generally designated by the reference numeral 10 will be described.

Figure 3:
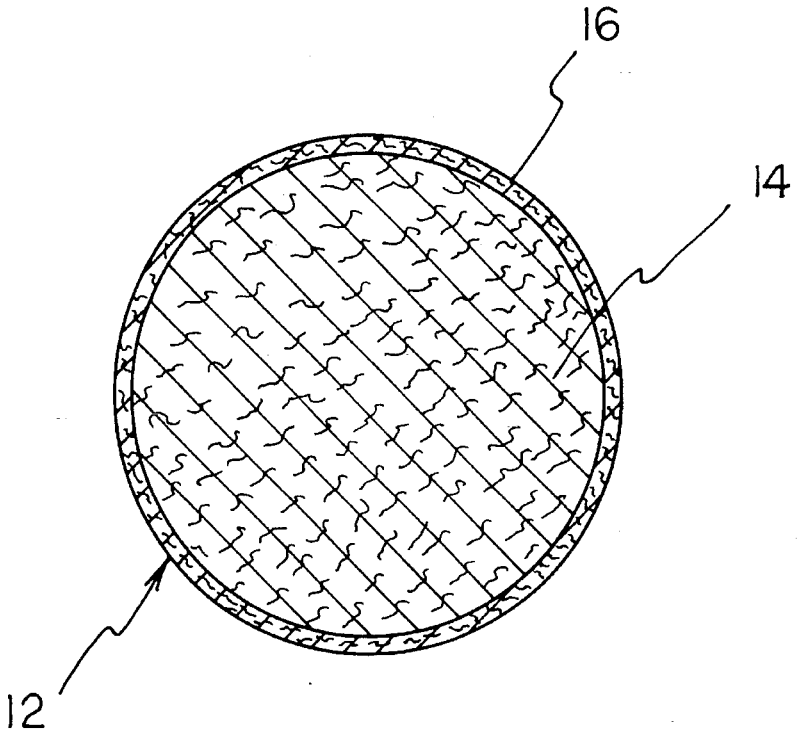
FIG. 3 is a cross-sectional view taken along line 3—3 of FIG. 2.

More specifically, it will be noted that the pillow pacifier 10 comprises an elongated main body 12 having any conceivable cross-sectional shape, but preferably having a substantially circular cross-section shape, as shown in FIG. 3. The main body 12 is preferably formed of a cylindrical foam member 14 encapsulated within an outer fabric casing 16. The outer casing 16 may comprise any resiliently deformable plastic fabric material suitable for washing within a conventional washing machine. The outer fabric casing 16 extends beyond unillustrated ends of the cylindrical foam member 14 and is sewn together to form tapered ends 18 at respectively opposed ends of the main body 12. As shown in FIG. 1, the main body 12 is operable to be grasped and manipulated by an infant 20 such that the main body 12 extends along a portion of a body 22 of the infant substantially as shown. Preferably, the main body 12 has a longitudinal length equal to approximately six times a transverse width thereof. Thus, the main body 12 will extend along approximately one-half of the overall length of the infant 20.

Figure 4:
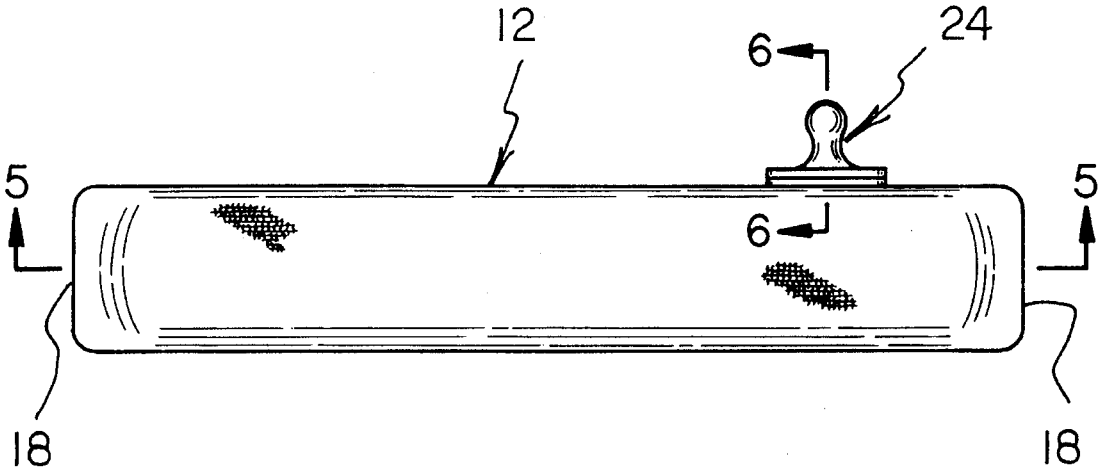
FIG. 4 is a further side elevation view of the device, per se.
Figure 5:
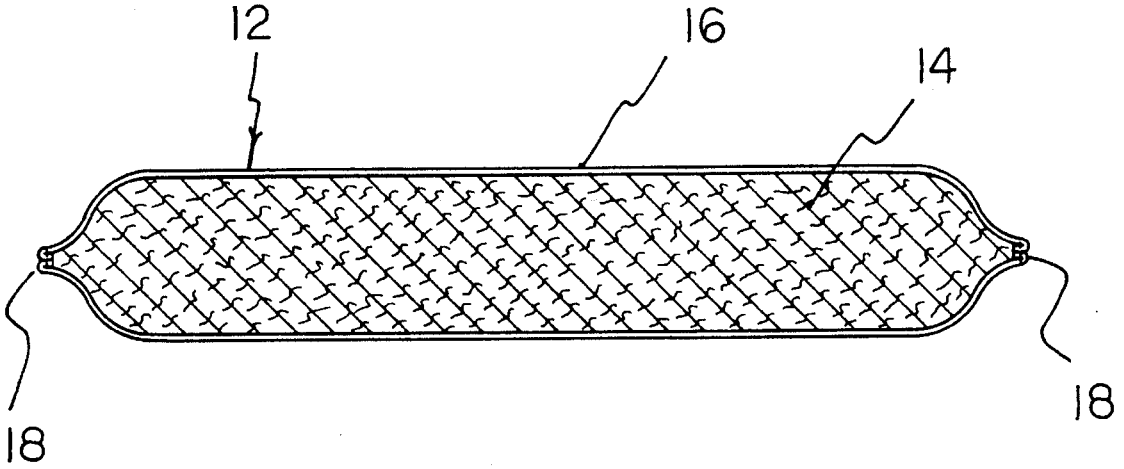
FIG. 5 is a cross-sectional view taken along line 5—5 of FIG. 4.
Figure 6:
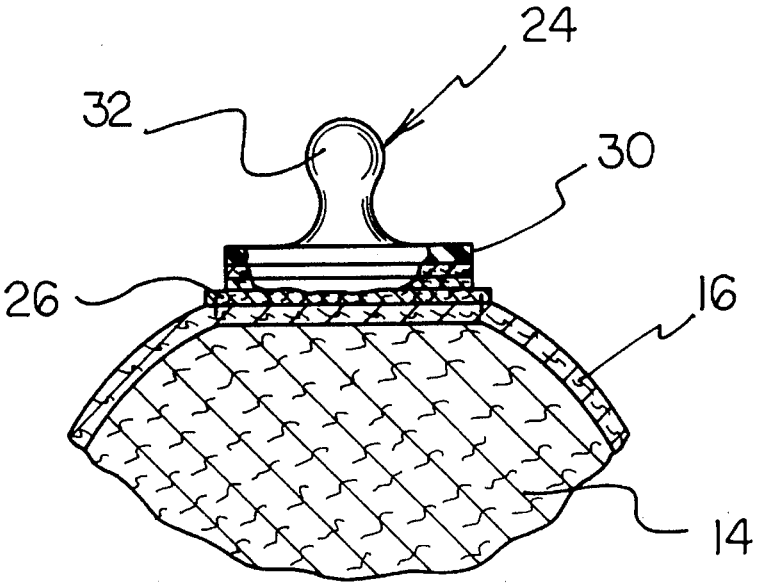
FIG. 6 is a further cross-sectional view taken along line 6—6 of FIG. 4.
Figure 7:
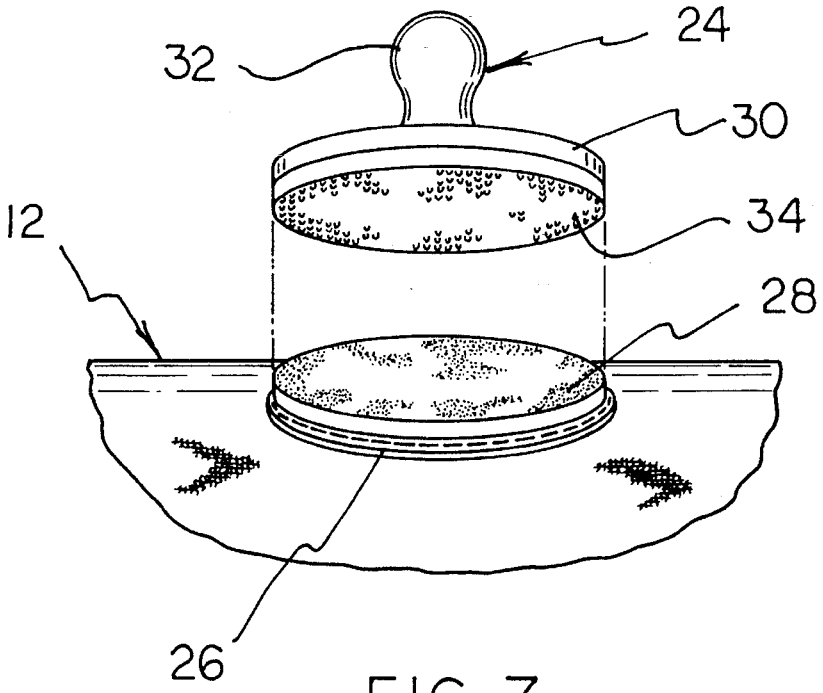
FIG. 7 is an exploded isometric illustration showing the detachable pacifier.

As best shown in FIG. 4, the present invention 10 further comprises a pacifier 24 removably coupled to a side of the main body 12. To this end, and as shown in FIGS. 6 and 7, a mounting boss 26 is secure to the outer fabric casing 16 by sewing, by an adhesive, or other similar mounting means, with the mounting boss having a first portion 28 of a fabric fastener secured to an exterior surface thereof. Accordingly, the pacifier 24 comprises a mounting plate 30 having a nipple projection 32 extending therefrom, with a second portion 34 of fabric fastener material being secured to a lower surface of the mounting plate 30 and engagable to the first portion 28 of the mounting boss 26 to effect securement of the pacifier 24 to the main body 12. Preferably, the pacifier 24 is integrally formed of a substantially resilient material, such as rubber, latex, or other conventionally known resilient materials. By this structure, the pacifier 24 can be removed for interchanging thereof with other similar pacifiers, and for permitting the immersion and washing of the main body 12.

Figure 8:
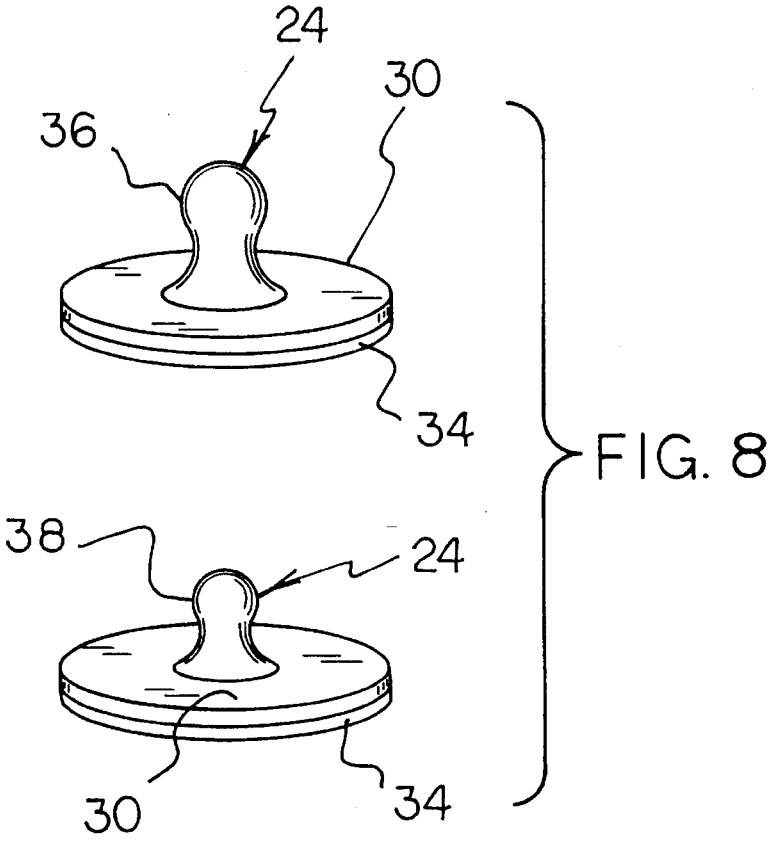
FIG. 8 is an isometric illustration of attachable pacifiers of various sizes.

As shown in FIG. 8, a plurality of pacifiers 24 can be provided so as to offer a variety of nipple projection sizes. To this end, a first one of the pacifiers 24 may comprise a large nipple projection 36 secured to the mounting plate 30, with a second one of the pacifiers comprising a small nipple projection 38 secured to the mounting plate. Thus, as the infant 20 continues to grow, the pacifiers 24 may be interchanged as desired.

In use, the pillow pacifier 10 is operable to satisfy both an infant's desire to bite and feed, as well as the infant's desire to grasp objects, as shown in FIG. 1. The pacifier 24 is positioned towards an end of the main body 12 such that the main body will extend along a center of the upper torso portion of the infant during use of the pacifier. Further, it is preferable that the tapered ends 18 be oriented so as to extend parallel to a longitudinal axis of the nipple 32 to provide for ease of ascertaining the orientation of the pacifier 24, as well as to provide a reference line observable to the infant for entertainment and for providing sensory feedback relative to the orientation of the device 10.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A pillow pacifier comprising:

an elongated main body formed from an elongated cylindrical foam member encapsulated within an outer casing having tapered ends;

a mounting boss fixedly secured to the outer casing; and, a pacifier removably coupled to the mounting boss on a side of said main body, wherein said main body is operable to satisfy an infant's desire to grasp objects while the pacifier is operable to satisfy an infant's desire to bite and feed.

2. The pillow pacifier of claim 1, wherein said main body has a substantially circular cross-section shape.

3. The pillow pacifier of claim 1 wherein said mounting boss is secured to said outer fabric casing by sewing or adhesive means, said mounting boss having a first portion of a fabric fastener secured to an exterior surface thereof; and further wherein said pacifier comprises a mounting plate having a nipple projection extending therefrom, with a second portion of fabric fastener material being secured to a lower surface of said mounting plate and engagable to said first portion of fabric fastener of said mounting boss to effect securement of said pacifier to said main body.

4. The pillow pacifier of claim 3, wherein said pacifier is positioned towards an end of said main body such that said main body will extend along a center of an upper torso portion of said infant during use of said pacifier.

5. The pillow pacifier of claim 4, wherein said outer fabric casing extends beyond ends of said cylindrical foam member and is sewn together to form said tapered ends at respectively opposed ends of said main body, said tapered ends being oriented so as to extend parallel to a longitudinal axis of said nipple to provide for ease of ascertaining an orientation of said pacifier, as well as to provide a reference line observable to said infant for entertainment and for providing sensory feedback relative to said orientation of said pacifier.

6. The pillow pacifier of claim 5, wherein said main body has a longitudinal length equal to approximately six times a transverse width thereof.

7. The pillow pacifier of claim 6, wherein said pacifier is integrally formed of a substantially resilient material.

8. The pillow pacifier of claim 7, in combination with a plurality of pacifiers, each of said pacifiers having a variety of nipple projection sizes.

9. The pillow pacifier of claim 8, wherein said outer casing comprises a resiliently deformable material.

10. The pillow pacifier of claim 8, wherein said outer casing comprises a fabric material suitable for washing.

11. A pillow pacifier comprising:

an elongated main body, said main body having a substantially circular cross-section shape, said main body being formed of an elongated cylindrical foam member encapsulated within an outer casing, said outer casing comprising a resiliently deformable plastic material;

a mounting boss fixedly secured to said outer fabric casing, said mounting boss having a first portion of a fabric fastener secured to an exterior surface thereof a pacifier removably coupled to the mounting boss on a side of said main body, wherein said main body is operable to satisfy an infant's desire to grasp objects while the pacifier is operable to satisfy an infant's desire to bite and feed, said pacifier comprising a mounting plate having a nipple projection extending therefrom, with a second portion of fabric fastener material being secured to a lower surface of said mounting plate and engagable to said first portion of fabric fastener of said mounting boss to effect securement of said pacifier to said main body, said mounting boss and said pacifier being positioned towards an end of said main body such that said main body will extend along a center of an upper torso portion of said infant during use of said pillow pacifier, wherein said outer fabric casing extends beyond ends of said cylindrical foam member and is sewn together to form tapered ends at respectively opposed ends of said main body, said tapered ends being oriented so as to extend parallel to a longitudinal axis of said nipple to provide for ease of ascertaining an orientation of said pacifier, as well as to provide a reference line observable to said infant for entertainment and for providing sensory feedback relative to said orientation of said pacifier.

12. The pillow pacifier of claim 11, wherein said pacifier is integrally formed of a substantially resilient material.

13. A pillow pacifier comprising:

an elongated main body, said main body having a substantially circular cross-section shape, said main body being formed of an elongated cylindrical foam member encapsulated within an outer casing, said outer casing comprising a fabric material suitable for washing;

a mounting boss fixedly secured to said outer fabric casing, said mounting boss having a first portion of a fabric fastener secured to an exterior surface thereof a pacifier removably coupled to the mounting boss on a side of said main body, wherein said main body is operable to satisfy an infant's desire to grasp objects while the pacifier is operable to satisfy an infant's desire to bite and feed, said pacifier comprising a mounting plate having a nipple projection extending therefrom, with a second portion of fabric fastener material being secured to a lower surface of said mounting plate and engagable to said first portion of fabric fastener of said mounting boss to effect securement of said pacifier to said main body, said mounting boss and said pacifier being positioned towards an end of said main body such that said main body will extend along a center of an upper torso portion of said infant during use of said pillow pacifier, wherein said outer fabric casing extends beyond ends of said cylindrical foam member and is sewn together to form tapered ends at respectively opposed ends of said main body, said tapered ends being oriented so as to extend parallel to a longitudinal axis of said nipple to provide for ease of ascertaining an orientation of said pacifier, as well as to provide a reference line observable to said infant for entertainment and for providing sensory feedback relative to said orientation of said pacifier.

14. The pillow pacifier of claim 13, wherein said pacifier is integrally formed of a substantially resilient material.

* * * * *